US007896710B2

(12) United States Patent
Deylitz et al.

(10) Patent No.: US 7,896,710 B2
(45) Date of Patent: Mar. 1, 2011

(54) ELECTRICAL CONTACT DEVICE

(75) Inventors: Erhard Deylitz, Berlin (DE); Michael Hahn, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/821,288

(22) Filed: Jun. 23, 2010

(65) Prior Publication Data

US 2010/0330834 A1 Dec. 30, 2010

(30) Foreign Application Priority Data

Jun. 25, 2009 (DE) ..... 10 2009 030 917

(51) Int. Cl.
*H01R 33/00* (2006.01)

(52) U.S. Cl. ..... 439/682

(58) Field of Classification Search ..... 439/682, 439/121, 122, 532, 716
See application file for complete search history.

(56) References Cited

U.S. PATENT DOCUMENTS 6,083,027 A 7/2000 Sato
6,193,561 B1 * 2/2001 Harting et al. ..... 439/682
7,789,714 B2 * 9/2010 Liu ..... 439/682
2002/0086577 A1 7/2002 Koch et al.

FOREIGN PATENT DOCUMENTS

DE 19519786 A1 12/1995
DE 10040651 A 3/2002

* cited by examiner

*Primary Examiner*—Tho D Ta
(74) *Attorney, Agent, or Firm*—Harness, Dickey & Pierce, P.L.C.

(57) ABSTRACT

An electrical contact device for an arrangement includes two apparatuses, between which a relative movement takes place along a first movement path. In at least one embodiment, the electrical contact device includes a first contact, including a first contact surface, and includes a second contact including a first multiplicity of contact arms, each provided with a contact projection for making contact with the first contact surface. In at least one embodiment, in order to prevent excessive friction wear to the first contacts even when the contact projections of the associated second contacts are arranged successively in the same direction as the first movement path, at least one device is provided for controlling a relative movement between the two contacts along a second movement path, which runs parallel to the first contact surface of the first contact and obliquely with respect to the first movement path.

16 Claims, 5 Drawing Sheets

ELECTRICAL CONTACT DEVICE

PRIORITY STATEMENT

The present application hereby claims priority under 35 U.S.C. §119 on German patent application number DE 10 2009 030 917.9 filed Jun. 25, 2009, the entire contents of which are hereby incorporated herein by reference.

FIELD

At least one embodiment of the invention generally relates to an electrical contact device for an arrangement having two apparatuses, between which a relative movement takes place along a first movement path, having a first contact, which has a first contact surface, and having a second contact, which has a first multiplicity of contact arms, which are each provided with a contact projection for making contact with the first contact surface.

BACKGROUND

Patent specification DE 195 19 786 C2 discloses an electrical contact device which has a flat-plug connection device with a plurality of first contacts in the form of flat-plug connections, and a socket connection device with a plurality of second contacts in the form of connections which are provided with self-supporting contact arms. In this case, each of these two connection devices is fitted in a fixed position to a respective apparatus. The two apparatuses can be fitted to one another by movement in a movement direction, wherein an electrical connection is made between the contacts at the same time when the two apparatuses are fitted to one another, and is maintained over a large movement distance of the relative movement of the two apparatuses.

In order to avoid excessive wear along a specific line on the flat-plug connections during this process, provision is made for the contact projections of mutually adjacent contact arms to be offset with respect to one another in a direction which runs transversely with respect to the movement direction, such that they slide along different points over the contact surface of the first contact associated with them.

SUMMARY

At least one embodiment of the invention is based on preventing excessive friction wear to the first contacts even when the contact projections of the associated second contact are arranged successively in the same direction as the first movement path.

In at least one embodiment, according to the invention, a device is provided for controlling a relative movement between the two contacts along a second movement path, which runs parallel to the contact surface of the first contact and obliquely with respect to the first movement path.

Preferred developments of the invention are specified in the dependent claims.

In at least one embodiment, the device for controlling the relative movement can therefore advantageously comprise a wedge control, by which the first contact and/or the second contact can be moved parallel to the first contact surface and obliquely with respect to the first movement path, or can be pivoted about a shaft which runs transversely with respect to the first contact surface.

In addition, the device for controlling the relative movement may comprise a return apparatus having a spring force which counteracts the wedge control or a positive guide which positively guides the relative movement between the two contacts along the second movement path.

Preferably, the first movement path with respect to which the contact projections are arranged successively in the same direction extends in a straight line in a movement direction.

A large movement distance of the relative movement of the apparatuses to be provided with the contacts can be taken into account in that during the relative movement of the two contacts, in an entry position and in a final position as well as in all the positions which can be assumed between the entry position and the final position, at least one of the successive contact projections on the second contact always makes contact with the contact surface, which slides along the contact projections on the contact arms, of the first contact.

A high contact pressure can advantageously be maintained in that the first contact is a contact blade which, in addition to the first contact surface, has a second contact surface, and in that the second contact is a sliding contact sleeve which is bent in a U-shape, wherein a first limb of the sliding contact sleeve is provided with the first multiplicity of contact arms in order to make contact with the first contact surface, and a second limb of the sliding contact sleeve is provided with a second multiplicity of contact arms in order to make contact with the second contact surface.

In order to make a multiplicity of electrical connections at the same time, a plurality of pairs of mutually associated first contacts and second contacts are provided, wherein the first contacts, which are provided with the contact surfaces, are arranged in a first housing in order to form a first contact module, and wherein the second contacts, which are provided with the contact arms, are arranged in a second housing, in order to form a second contact module.

When using the electrical contact device according to at least one embodiment of the invention, in the case of an arrangement having at least two apparatuses between which a relative movement takes place along a first movement path, wherein a first of the two apparatuses is an electrical switch, and the second of the two apparatuses is a withdrawable frame, the first contact module can be held on the electrical switch, and the second contact module can be held on the withdrawable frame.

BRIEF DESCRIPTION OF THE DRAWINGS

Advantageous embodiments of the invention will be described in the following text with reference to the following figures, in which.

DETAILED DESCRIPTION OF THE EXAMPLE EMBODIMENTS

Figure 1:
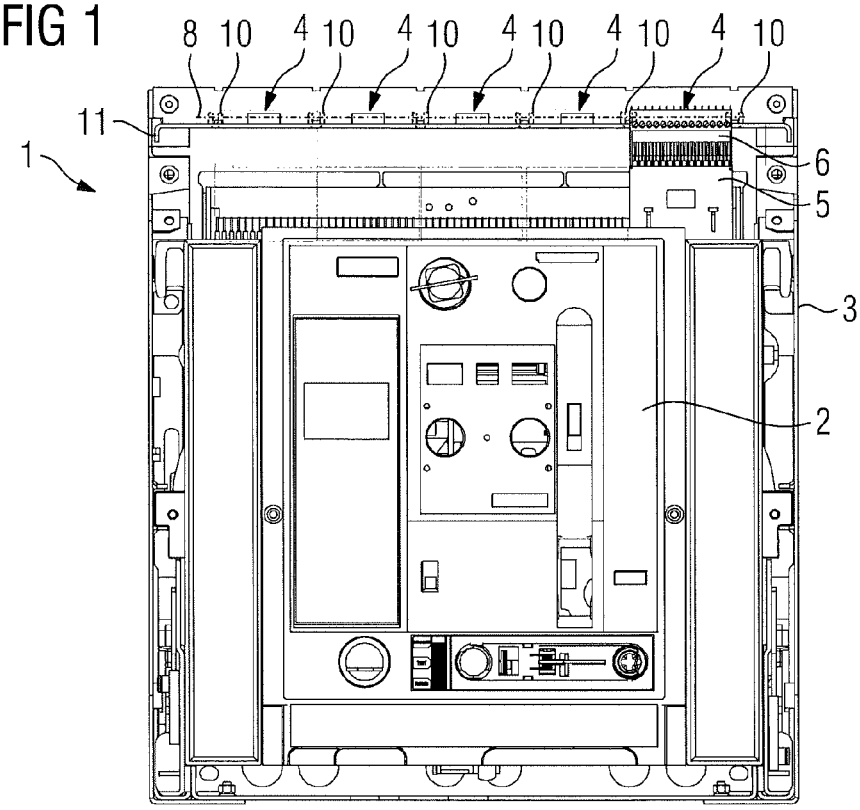
FIG. 1 shows an electrical switching arrangement comprising an electrical switch, a withdrawable frame into which the electrical switch can be inserted, and a first embodiment of the electrical contact device according to an embodiment of the invention, wherein a first contact module of the contact device is attached to the electrical switch, and a second contact module of the contact device is attached to the withdrawable frame.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIGS. 1 to 4 show an electrical switching arrangement comprising a first apparatus in the form of an electrical switch 2 (in particular in the form of a low-voltage circuit breaker), a second apparatus in the form of a withdrawable frame 3, and an electrical contact device 4 which has two contact modules 5, 6.

Figure 3:
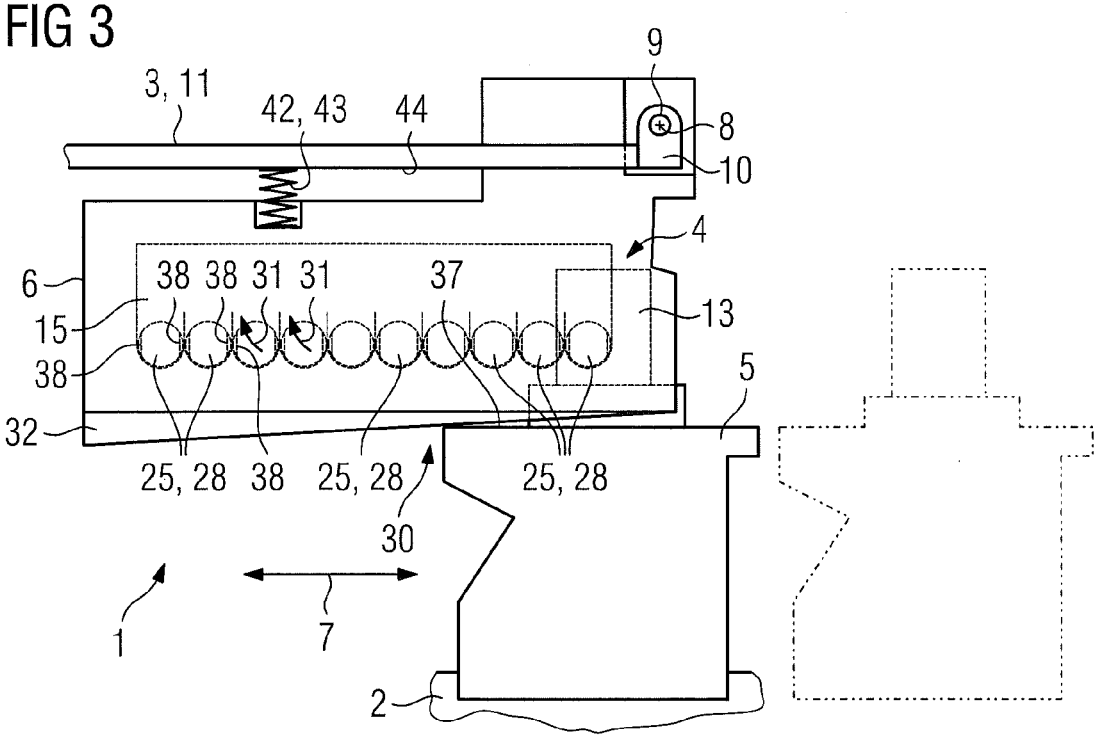
Figure 4:
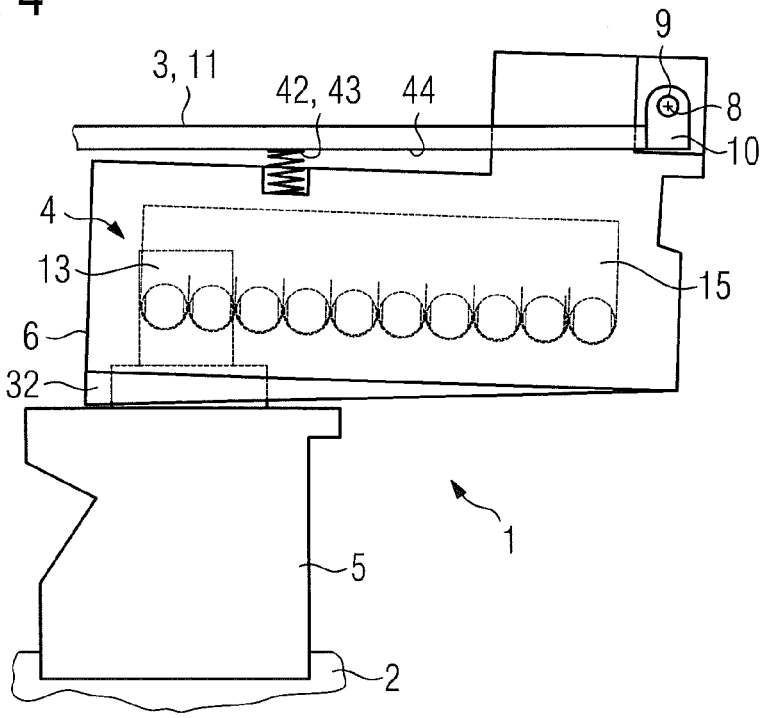

According to FIGS. 3 and 4, a relative movement takes place between the two apparatuses along a first movement path 7, wherein, in this case, the electrical switch 2 can be inserted into the withdrawable frame in a known manner in one movement direction, and can be withdrawn from the withdrawable frame again as well, that is to say the first movement path 7 extends in a straight line in the movement direction.

The first of the two contact modules of the electrical contact device 4, which is annotated with the reference symbol 5 and is also referred to as a contact blade module, is held on the electrical switch 2, and the second of the contact modules, which is annotated with the reference symbol 6 and is also referred to as a sliding contact module, is held on the withdrawable frame 3. The two contact modules are used in a known manner for connection of auxiliary conductors.

In addition to the illustrated electrical contact device 4, further such electrical contact devices, which are illustrated only schematically by dashed-dotted lines here, can be arranged for connection of further auxiliary conductors.

The second of the contact modules 6 can pivot about a shaft 8. This shaft is borne in bearing openings 9 in holding lugs 10, which are bent in a U-shape, of a lateral strut 11 of the withdrawable frame, and runs parallel to the lateral strut 11, and therefore transversely with respect to the first movement path 7.

Figure 2:
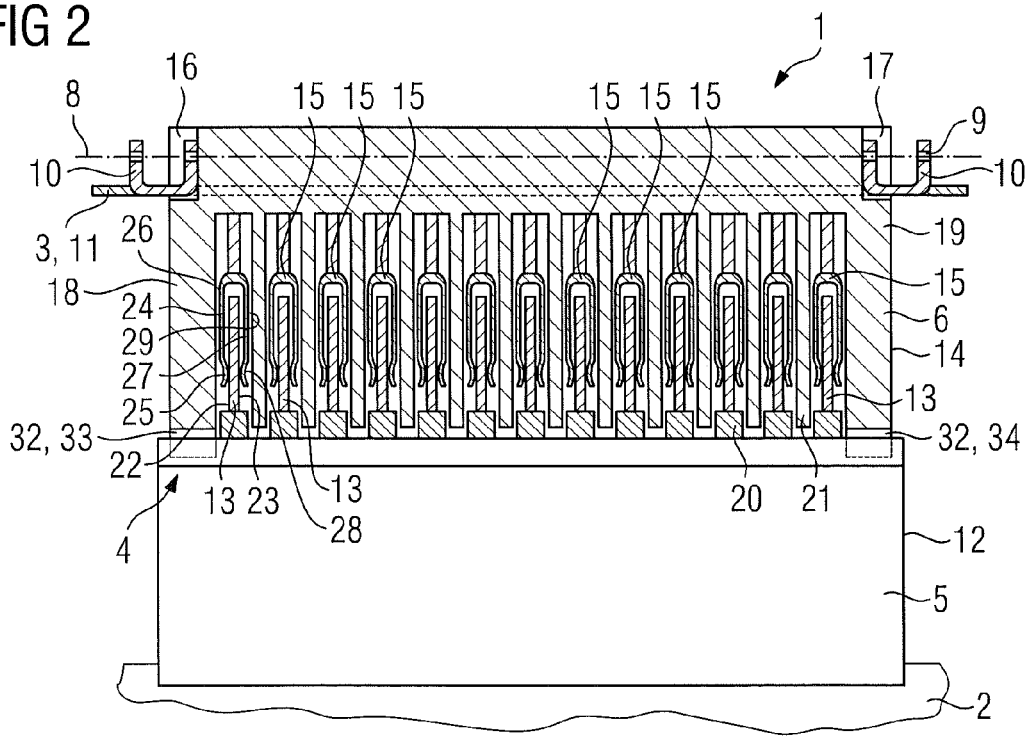
FIGS. 2 to 4 show the first embodiment of the electrical contact device as shown in FIG. 1, FIGS. 5 to 7 show a second embodiment of the electrical contact device.

According to FIG. 2, the first contact module 5 has a housing 12 and a plurality of first contacts 13 which are arranged parallel to one another in the housing. The second contact module 6 likewise has a housing 14, in which a plurality of second contacts 15 are arranged, wherein two of the holding lugs engage in recesses 16, 17 in the left-hand side wall 18 and the right-hand side wall 19 of this housing 14.

In order to mutually align mutually associated pairs of the first and second contacts, the housing 12 of the first contact module 5 forms sliding guide projections 20, which are arranged essentially around the first contacts 13 and interact with corresponding ribs 21, which are formed by the housing 14 of the second contact module 6 and between which the second contacts 15 extend.

In this case, each of the first contacts 13 is in the form of a contact blade, which forms a first contact surface 22 and a second contact surface 23. Each of the second contacts is in the form of a sliding contact sleeve which is bent in a U-shape, wherein a first limb 24 of the sliding contact sleeve has a first multiplicity of self-supporting contact arms 26, which are each provided with contact projections 25, in order to make contact with the first contact surface 22, and wherein, analogously, a second limb 27 of the sliding contact sleeve has a second multiplicity of self-supporting contact arms 29, which are each provided with contact projections 28, in order to make contact with the second contact surface 23.

As shown in FIG. 3, the contact projections 25, 28 are arranged successively in the same direction as the first movement path 7.

Therefore, during the relative movement of the two contacts 13, 15—starting with an entry position of the contacts as shown in FIG. 3, in which the electrical switch 2 has assumed its test position in the withdrawable frame 3 and the contact surfaces 22, 23 make contact with the first of the contact projections 25, 28, to a final position of the contacts, as shown in FIG. 4, in which the electrical switch 2 has assumed its operating position in the withdrawable frame 3—at least one of the successive contact projections 25, 28 on each of the two limbs of the second contact 15 always makes contact with the respectively associated contact surface 22, 23, which slides along the contact projections on the contact arms, of the first contact 13.

During movement of the electrical switch 2, the contact surfaces 22, 23 of the first contact 13—starting in the test position of the electrical switch (entry position of the contacts) to the operating position of the electrical switch (final position of the contacts) and back—therefore carry out a sliding movement on the contact projections 25, 28 of the second contacts 15.

In order during this process to avoid excessive wear to the contact surfaces 22, 23 of the first contacts, the electrical contact device 4 has a device, which is annotated 30 as an entity, for controlling a relative movement between the two contacts 13, 15 along a second movement path 31, which runs parallel to the contact surfaces 22, 23 of the first contact 13, and obliquely with respect to the first movement path 7.

In the first embodiment 4 of the electrical contact device as shown in FIGS. 2 to 4, the means 30 for controlling the relative movement comprises a wedge control 32, by which the second contact module 6, and therefore each of the second contacts 15, can be pivoted parallel to the contact surfaces 22, 23 and obliquely with respect to the first movement path 5 about the shaft 8 which runs transversely with respect to the contact surfaces. This wedge control 32 is formed by two wedge-shaped end sections 33, 34 of the side walls 35, 36 of the housing 14 of the second contact module 6, against which an upper wall 37 of the first contact module 5 runs when the electrical switch is being inserted into the withdrawable frame. As a result of the pivoting of the second contact module in the clockwise direction about the shaft 8 that occurs during this process, the contact projections 25, 28 on the self-supporting contact arms 26, 29 slide at different points over the contact surfaces 22, 23 of the first contacts 13 as they slide past.

The self-supporting contact arms 26, 29 have side edges 38, in a known manner, which extend outward and allow the respective contact blade to enter, and allow the mutually opposite self-supporting contact arms to bend away from one another.

Figure 5:
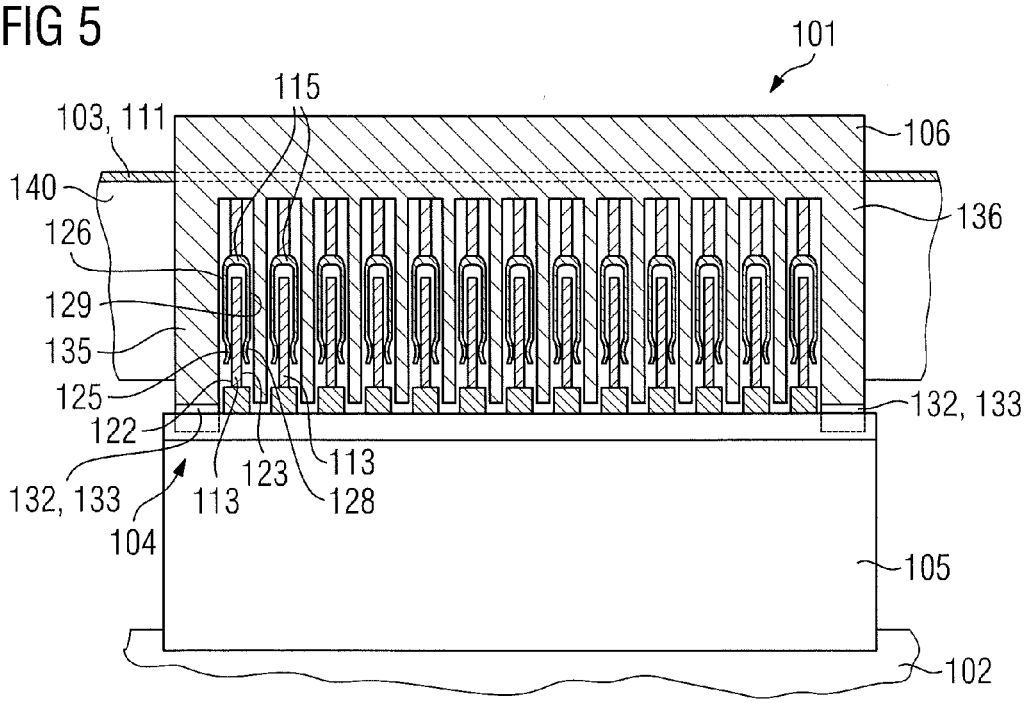
Figure 6:
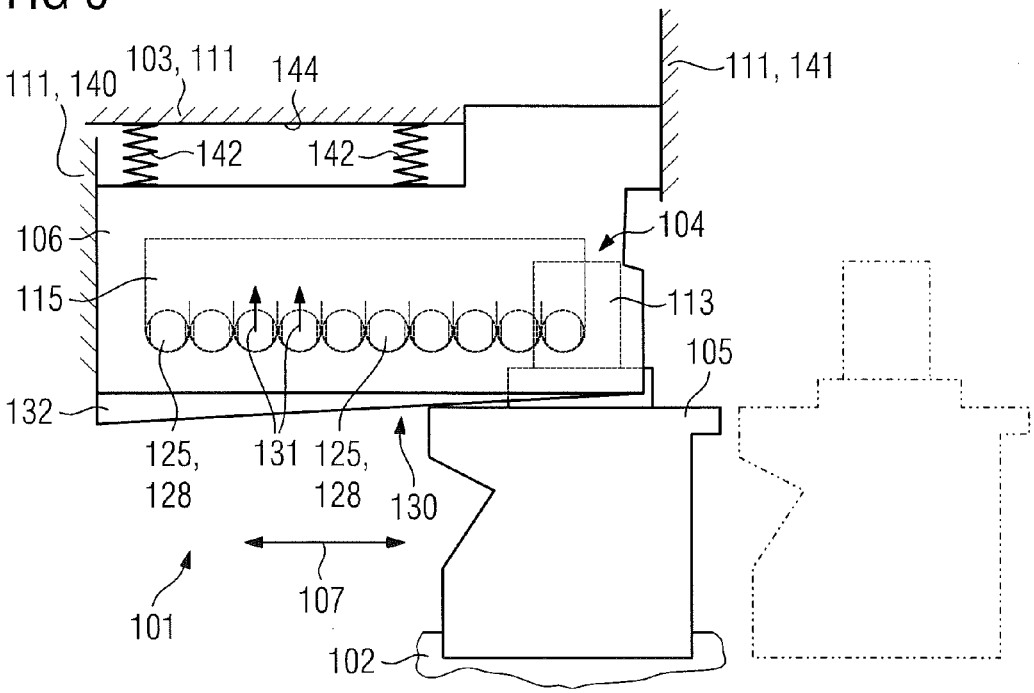
Figure 7:
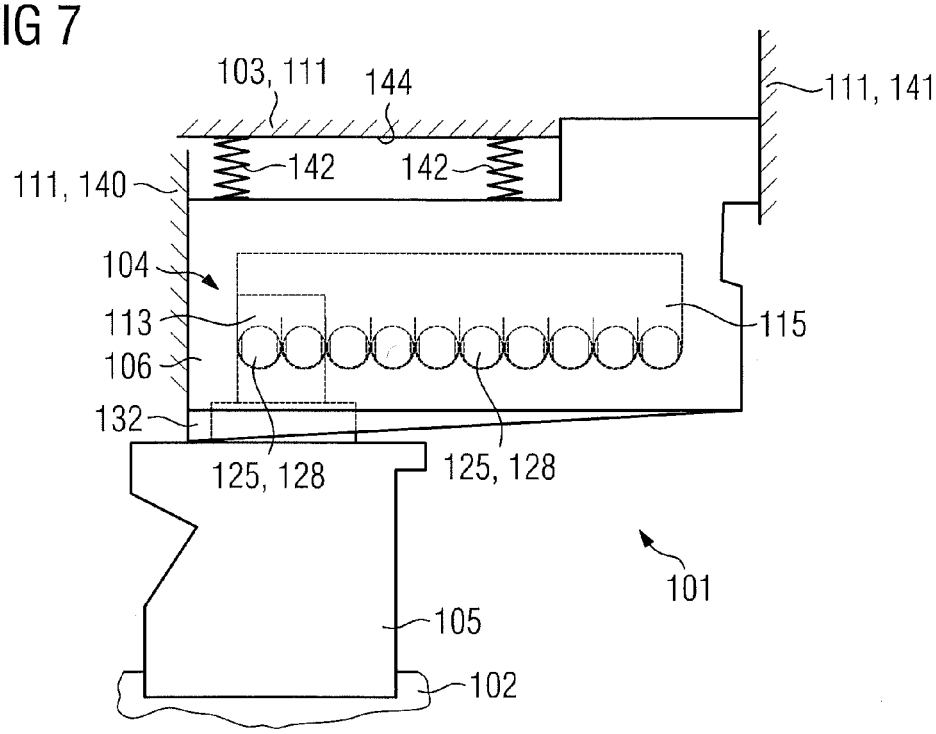

In the second embodiment 104 of the electrical contact device shown in FIGS. 5 to 7, the means 130 for controlling the relative movement likewise comprises a wedge controller 132. However, in this case, vertical guide surfaces 140, 141, that is to say surfaces which run transversely with respect to the movement direction 107, are formed on a lateral strut 111 of the withdrawable frame 103, in order to move the second contact module 106 and therefore each of the second contacts 115 parallel to the contact surfaces 122, 123 and obliquely with respect to the first movement path 107, which extends in the movement direction.

However, within the scope of at least one embodiment of the invention, it is also additionally possible for the first contact module and therefore the first contacts to be moved parallel to the first contact surface and obliquely with respect to the first movement path, or to pivot about a shaft which runs transversely with respect to the first contact surface, in addition to or instead of the second contact module.

As shown in FIGS. 3 and 4 as well as 5 and 6, the device 30; 130 for controlling the relative movement in the first embodiment 4 of the electrical contact device and in the second embodiment 104 of the electrical contact device has a return apparatus 42; 142 with a spring force which counteracts the wedge control 32; 132. This return apparatus comprises a spring 43; 143, which is supported on a wall 44; 144 of the lateral strut 11; 111.

Figure 8:
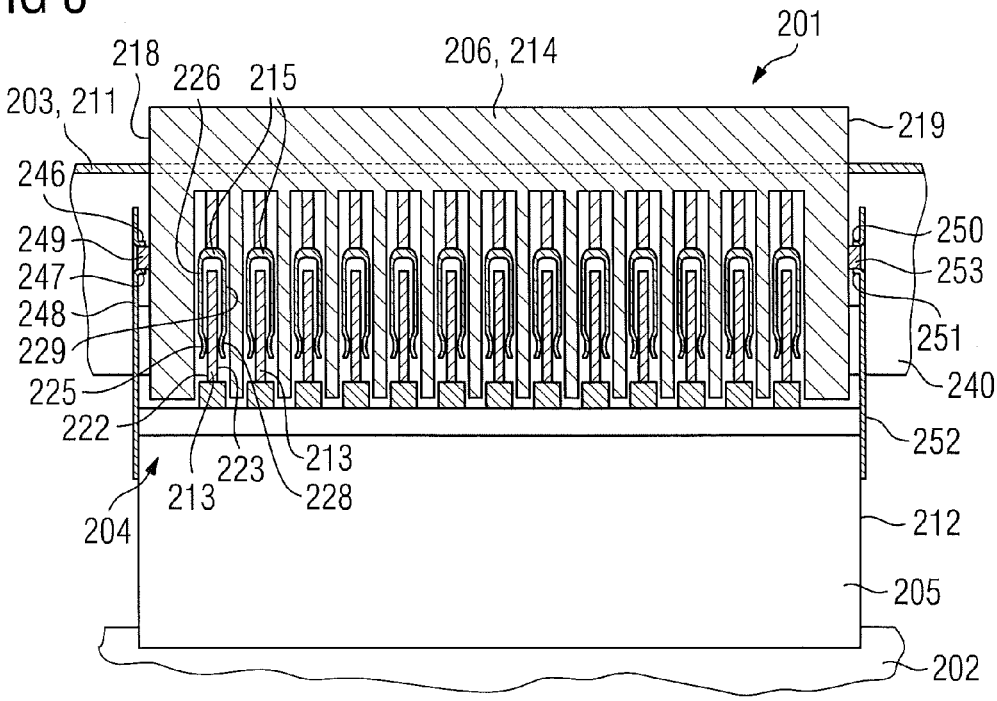
FIGS. 8 to 10 show a third embodiment of the electrical contact device.
Figure 9:
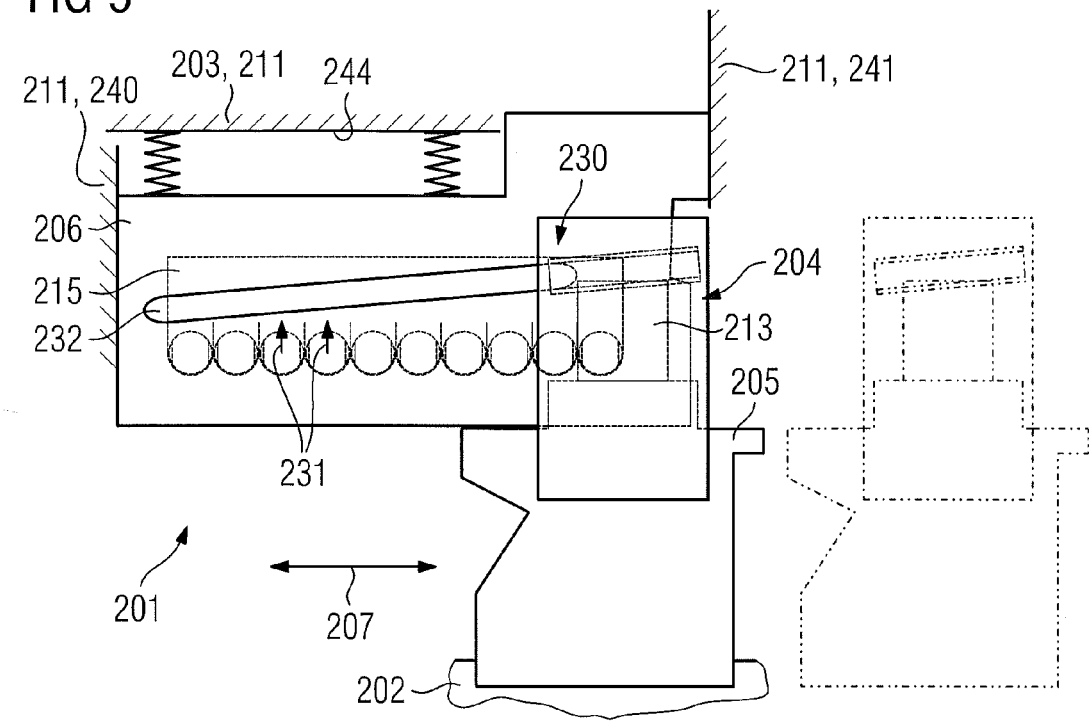
Figure 10:
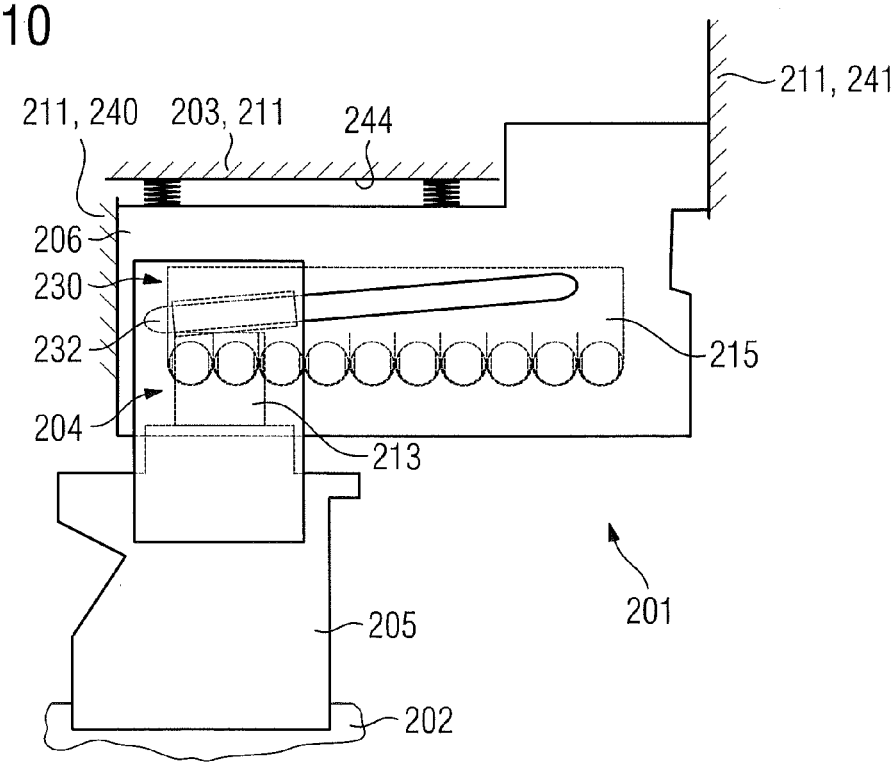

In the third embodiment 204 of the electrical contact device shown in FIGS. 8 to 10, the device 230 for controlling the relative movement comprises a wedge control 232 in the form of a positive guide, by which the second contact module 206 and therefore each of the second contacts 215 are guided such that they can be moved positively, parallel to the contact surfaces 222, 223 and obliquely with respect to the first movement path 207, which extends in the movement direction.

For this purpose, a first pair of bent-out lugs 246, 247 of a left-hand side wall 248, which is formed on the housing 212 of the first contact module 205, clasps a first guide rib 249, which runs obliquely with respect to the first movement path 205 and is formed on the left-hand side wall 218 of the housing 214 of the second contact module 206. Analogously to this, a second pair of bent-out lugs 250, 251 of a right-hand side wall 252, which is formed on the housing 212 of the first contact module 205, clasps a second guide rib 253, which runs obliquely with respect to the first movement path 205 and is formed on the right-hand side wall 219 of the housing 214 of the second contact module 206.

In this case as well, vertical guide surfaces 240, 241, that is to say surfaces which run transversely with respect to the movement direction 207, are provided on a lateral strut 211 on the withdrawable frame 203.

In particular when used for a switching contact arrangement which is formed from an electrical switch and a withdrawable frame—the following embodiments of the novel electrical contact device are preferred within the scope of at least one embodiment of the invention:

- a contact device 4, in which the sliding contact sleeves are pivoted against a spring force at a rear or front rotation point relative to the movement direction,
- a contact device, in which the sliding contact sleeves are positively pivoted by means of a positive guide at a rear or front rotation point relative to the movement direction,
- a contact device 104, in which the sliding contact sleeves are raised/lowered against a spring force by way of a wedge control,
- a contact device 204, in which the sliding contact sleeves are positively raised/lowered by way of a wedge control in the form of a positive guide,
- a contact device, in which the contact blades are pivoted against a spring force at a rear or front rotation point relative to the movement direction,
- a contact device, in which the contact blades are positively pivoted by way of a positive guide at a rear or front rotation point relative to the movement direction, a contact device 104, in which the contact blades are raised/lowered by way of a wedge control against a spring force, and a contact device 204, in which the contact blades are positively raised/lowered by way of a wedge control in the form of a positive guide.

The second contacts, which are provided with the contact arms, can be designed such that the contact arms which make contact in the entry position are prestressed to a lesser extent (resting with a lesser contact force on the contact surfaces of the first contact) than the contact arms which make contact in the final position. This can be achieved, for example, by the length of the separating slots between the self-supporting contact arms decreasing in the movement direction.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electrical contact device for an arrangement including two apparatuses, between which a relative movement takes place along a first movement path, the electrical contact device comprising:

a first contact including a first contact surface;

a second contact including a first multiplicity of contact arms, which are each provided with a contact projection for making contact with the first contact surface, the contact projections being arranged successively in a same direction as the first movement path; and at least one device to control a relative movement between the first and second contacts along a second movement path, which runs parallel to the first contact surface of the first contact and obliquely with respect to the first movement path.

2. The electrical contact device as claimed in claim 1, wherein the at least one device to control the relative movement comprises a wedge control, by which at least one of the first contact and the second contact is movable parallel to the first contact surface and obliquely with respect to the first movement path, or is pivotable about a shaft which runs transversely with respect to the first contact surface.

3. The electrical contact device as claimed in claim 2, wherein the at least one device to control the relative movement comprises a return apparatus having a spring force which counteracts the wedge control.

4. The electrical contact device as claimed in claim 2, wherein the at least one device to control the relative movement comprises a positive guide, by which the relative movement between the two contacts is positively guided along the second movement path.

5. The electrical contact device as claimed in claim 1, wherein the first movement path with respect to which the contact projections are arranged successively in the same direction extends in a straight line in a movement direction.

6. The electrical contact device as claimed in claim 1, wherein, during the relative movement of the two contacts, in an entry position, in a final position, and in all the positions which are assumable between the entry position and the final position, at least one of the successive contact projections on the second contact always makes contact with the contact surface, which slides along the contact projections on the contact arms, of the first contact.

7. The electrical contact device as claimed in claim 1, wherein the first contact is a contact blade which, in addition to the first contact surface, includes a second contact surface, and wherein the second contact is a sliding contact sleeve which is bent in a U-shape, wherein a first limb of the sliding contact sleeve is provided with the first multiplicity of contact arms in order to make contact with the first contact surface, and a second limb of the sliding contact sleeve is provided with a second multiplicity of contact arms in order to make contact with the second contact surface.

8. The electrical contact device as claimed in claim 1, wherein a plurality of pairs of mutually associated first contacts and second contacts are provided, wherein the first contacts, which are provided with the contact surfaces, are arranged in a first housing in order to form a first contact module, and wherein the second contacts, which are provided with the contact arms, are arranged in a second housing, in order to form a second contact module.

9. An arrangement comprising:

at least two apparatuses, between which a relative movement takes place along a first movement path; and an electrical contact device designed as claimed in claim 1.

10. The arrangement as claimed in claim 9, wherein the first apparatus is an electrical switch, and the second apparatus is a withdrawable frame, and wherein the first contact module is held on the electrical switch, and the second contact module is held on the withdrawable frame.

11. The electrical contact device as claimed in claim 2, wherein the first movement path with respect to which the contact projections are arranged successively in the same direction extends in a straight line in a movement direction.

12. The electrical contact device as claimed in claim 2, wherein, during the relative movement of the two contacts, in an entry position, in a final position, and in all the positions which are assumable between the entry position and the final position, at least one of the successive contact projections on the second contact always makes contact with the contact surface, which slides along the contact projections on the contact arms, of the first contact.

13. The electrical contact device as claimed in claim 2, wherein the first contact is a contact blade which, in addition to the first contact surface, includes a second contact surface, and wherein the second contact is a sliding contact sleeve which is bent in a U-shape, wherein a first limb of the sliding contact sleeve is provided with the first multiplicity of contact arms in order to make contact with the first contact surface, and a second limb of the sliding contact sleeve is provided with a second multiplicity of contact arms in order to make contact with the second contact surface.

14. The electrical contact device as claimed in claim 2, wherein a plurality of pairs of mutually associated first contacts and second contacts are provided, wherein the first contacts, which are provided with the contact surfaces, are arranged in a first housing in order to form a first contact module, and wherein the second contacts, which are provided with the contact arms, are arranged in a second housing, in order to form a second contact module.

15. An arrangement comprising:

at least two apparatuses, between which a relative movement takes place along a first movement path; and an electrical contact device designed as claimed in claim 2.

16. The arrangement as claimed in claim 15, wherein the first apparatus is an electrical switch, and the second apparatus is a withdrawable frame, and wherein the first contact module is held on the electrical switch, and the second contact module is held on the withdrawable frame.

* * * * *